US008079416B2

(12) United States Patent
Parker

(10) Patent No.: US 8,079,416 B2
(45) **Date of Patent: *Dec. 20, 2011**

(54) PLUG FOR A PERFORATED LINER AND METHOD OF USING SAME

(75) Inventor: Perry Parker, Calgary (CA)

(73) Assignee: Reservoir Management Inc., St. Michael (BB)

( * ) Notice: Subject to any disclaimer, the term of this patent is extended or adjusted under 35 U.S.C. 154(b) by 171 days.

This patent is subject to a terminal disclaimer.

(21) Appl. No.: 12/506,744

(22) Filed: Jul. 21, 2009

(65) Prior Publication Data

US 2010/0230103 A1 Sep. 16, 2010

Related U.S. Application Data

(63) Continuation-in-part of application No. 12/403,576, filed on Mar. 13, 2009.

(51) Int. Cl.
*E21B 33/12* (2006.01)

(52) U.S. Cl. ..... 166/285; 166/376

(58) Field of Classification Search ..... 166/285, 166/242.1, 242.7

See application file for complete search history.

(56) References Cited

U.S. PATENT DOCUMENTS

| | | | | |
|---|---|---|---|---|
| 921,337 | A | 5/1909 | Archer | |
| 1,811,235 | A | 6/1931 | King | |
| 3,425,491 | A | 2/1969 | Zandmer | |
| 3,429,512 | A | 2/1969 | Bodine, Jr. | |
| 3,645,563 | A * | 2/1972 | Rochelle | 285/24 |
| 4,103,739 | A * | 8/1978 | Hall | 166/105 |
| 4,285,398 | A | 8/1981 | Zandmer et al. | |
| 4,519,451 | A * | 5/1985 | Gray et al. | 166/278 |
| 4,688,486 | A * | 8/1987 | Hall et al. | 102/489 |
| 5,165,478 | A | 11/1992 | Wilson | |
| 5,228,518 | A * | 7/1993 | Wilson et al. | 166/369 |
| 5,425,424 | A | 6/1995 | Reinhardt et al. | |
| 5,492,173 | A * | 2/1996 | Kilgore et al. | 166/66.4 |
| 6,119,776 | A | 9/2000 | Graham et al. | |
| 6,349,770 | B1 * | 2/2002 | Brooks et al. | 166/383 |
| 6,672,385 | B2 | 1/2004 | Kilaas et al. | |
| 6,719,051 | B2 | 4/2004 | Hailey, Jr. et al. | |
| 6,755,249 | B2 | 6/2004 | Robison et al. | |
| 6,899,176 | B2 | 5/2005 | Hailey, Jr. et al. | |

(Continued)

OTHER PUBLICATIONS

"Advancing Reservoir Performance" website download from Bakerhughesdirect.com dated Jun. 22, 2009.

(Continued)

*Primary Examiner* — David Bagnell
*Assistant Examiner* — Jacob Hall
(74) *Attorney, Agent, or Firm* — Honigman Miller Schwartz and Cohn LLP

(57) ABSTRACT

A plug for insertion into a perforation in a liner or tubular. The plug comprises a base portion and one or more extendible portions. The base portion is securable to and receivable within the perforation. The base portion and the one or more extendible portions seal the perforation in the liner. The one or more extendible portions have a retracted position and an extended position such that when in their extended position the one or more extendible portions extend outwardly from the base portion and outwardly from the exterior surface of the liner. The plug including one or more shear pins retaining such extendible portions in said retracted position until sufficient force is applied to shear said shear pins.

13 Claims, 10 Drawing Sheets

U.S. PATENT DOCUMENTS

| | | | | |
|---|---|---|---|---|
| 6,907,936 | B2 | 6/2005 | Fehr et al. | |
| 6,986,390 | B2 * | 1/2006 | Doane et al. | 166/285 |
| 7,201,232 | B2 * | 4/2007 | Turner et al. | 166/374 |
| 7,249,635 | B2 * | 7/2007 | Dennistoun et al. | 166/373 |
| 7,422,069 | B2 * | 9/2008 | Richard et al. | 166/382 |
| 7,527,103 | B2 * | 5/2009 | Huang et al. | 166/311 |
| 7,703,520 | B2 | 4/2010 | Dusterhoft | |
| 7,712,529 | B2 | 5/2010 | Dusterhoft et al. | |
| 7,814,973 | B2 | 10/2010 | Dusterhoft et al. | |
| 7,828,068 | B2 | 11/2010 | Gano et al. | |
| 7,841,409 | B2 | 11/2010 | Gano et al. | |
| 7,866,383 | B2 * | 1/2011 | Dusterhoft et al. | 166/227 |
| 2003/0136562 | A1 | 7/2003 | Robison et al. | |
| 2005/0121203 | A1 | 6/2005 | Richard et al. | |
| 2005/0284633 | A1 * | 12/2005 | Richard | 166/278 |
| 2007/0227733 | A1 | 10/2007 | Vercaemer et al. | |
| 2008/0035349 | A1 | 2/2008 | Richard | |
| 2009/0114385 | A1 | 5/2009 | Lumbye | |
| 2009/0133882 | A1 | 5/2009 | Delaloye et al. | |
| 2009/0211759 | A1 | 8/2009 | East, Jr. et al. | |
| 2009/0250571 | A1 * | 10/2009 | Laws | 248/188.5 |
| 2009/0321076 | A1 | 12/2009 | Wiley et al. | |
| 2010/0230100 | A1 | 9/2010 | Parker | |
| 2010/0236787 | A1 * | 9/2010 | Hall | 166/369 |
| 2010/0310242 | A1 * | 12/2010 | Zubalsky et al. | 396/12 |

OTHER PUBLICATIONS

Brochure "Teleperf Technology", Baker Hughes.
Office Action dated Mar. 11, 2011 for U.S. Appl. No. 12/403,576.

* cited by examiner

PLUG FOR A PERFORATED LINER AND METHOD OF USING SAME

CROSS-REFERENCE TO RELATED APPLICATIONS

This Application is a Continuation-in-part of application Ser. No. 12/403,576 filed on Mar. 13, 2009.

FIELD OF THE INVENTION

This invention relates generally to an apparatus and its use in plugging perforated liners such as those that may be used in wellbores and other installations.

BACKGROUND OF THE INVENTION

In conventional drilling operations it is often common to line the interior walls of a well with a liner (which is often a steel or other alloy pipe or tubular) in order to stabilize the wellbore and prevent collapse, particularly in loose or fractured formations. The space or annulus between the face of the formation and the liner may be packed with sand, gravel or other material. In other instances the liner is cemented in place through pumping cement or a cementatous-type material into the annulus. Upon setting, the cement serves to stabilize the position of the liner within the wellbore, helps to prevent a collapse, sloughing and cracking of the exposed formation face and can further help to prevent the escape of fluids from the formation. Where the wellbore passes through a formation that is saturated with water, cementing the liner in place can help to prevent the release of water from the formation into the well. In other instances cementing of the liner will help prevent the release of gas where the well passes through formations that harbour pressurized gas. Where there are multiple zones that are targeted for the production of fluid, in some instances it may be desirable to seal off particular zones through cementing the liner in place to permit the controlled and systematic release of fluid from particular zones in a particular sequence.

Typically where a liner has been cemented within a production zone once the cement has hardened and cured the well is reentered in order to perforate the liner and to allow for the extraction of production fluid. A variety of mechanisms and techniques have been developed in order to perforate a liner, most of which involve the lowering of a perforating gun into the tubular and using the gun to perforate the liner or well casing. Such guns typically utilize shaped charges that produce holes within the side of the liner having a relatively consistent size and shape. Others have proposed various other mechanical devices to punch or drill holes in liners once they are in place. Still others have devised liners themselves that are pre-fitted with small explosive charges that can be detonated after the liner has been connected in place in order to perforate a particular zone or section of the liner.

In other applications liners are pre-drilled at the surface with solid aluminium or similar plugs inserted into the holes, following which the liner is lowered and placed into position within the well. Once in the well the liner can be cemented in place, with the plugs retaining the cement slurry within the annulus formed between the formation face and the exterior surface of the liner. After the cement has set the plugs can then be removed, effectively creating a perforated liner. Removal of the plugs can be achieved mechanically, ultrasonically, or through packing off the section of the liner in question and introducing an acid to dissolve the material from which the plugs are made.

While the above described methods and devices have met with varying degrees of success, they all suffer from their own inherent limitations and difficulties. The formation of holes or perforations within a liner through the use of an explosive raises obvious concerns in the case of an oil or gas well where flammable or explosive materials may be present. Many of the currently employed methods require the lowering of relatively complex and expensive equipment into the well in order to mechanically, explosively or otherwise perforate the liner. Further, where the liner is cemented in place the mechanism used to perforate the liner or remove a plug that was previously inserted into a perforation is often incapable of removing or otherwise displacing the cement that has set up and hardened between the liner and the face of the formation. In such cases extracting fluid from the formation through the perforated liner can be difficult or inefficient.

SUMMARY OF THE INVENTION

The invention therefore provides a plug for a perforated liner and a method of using such a plug that addresses a number of the deficiencies in the structures and methods that are currently in use.

Accordingly, in one of its aspects the invention provides a plug for insertion into a perforation in a liner or tubular, the plug comprising a base portion and one or more extendible portions, said base portion securable to and receivable within said perforation said base portion and said one or more extendible portions sealing the perforation in said liner, said one or more extendible portions having a retracted position and an extended position such that when in said extended position said one or more extendible portions extend outwardly from said base portion and outwardly from the exterior surface of said liner.

In a further aspect the invention provides a plug for insertion into a perforation in a liner or tubular, the plug comprising a base portion securable to and received within a perforation in said liner, the plug further comprising one or more extendible portions having a retracted position and an extended position, when in said extended position said one or more extendible portions extending outwardly from said base portion and outwardly from the exterior surface of said liner, said base portion and said one or more extendible portions together sealing the perforation in said liner.

The invention also concerns a method of using and deploying a plug for insertion into a perforation in a liner or tubular to be inserted into a bore hole, the plug comprising a base portion and one or more extendible portions, said base portion securable to and receivable within the perforation, said one or more extendible portions having a retracted position and an extended position, said one or more extendible portions extending outwardly from said base portion and outwardly from the exterior surface of said liner when in said extended positions, the method comprising:

(i) inserting said plug into a perforation in the liner or tubular and securing said plug thereto;

(ii) positioning the liner or tubular at a desired location within a wellbore; and, (iii) pressurizing the interior of the liner or tubular to move said one or more extendible portions from said retracted to said extended positions such that they extend outwardly from the exterior surface of said liner.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
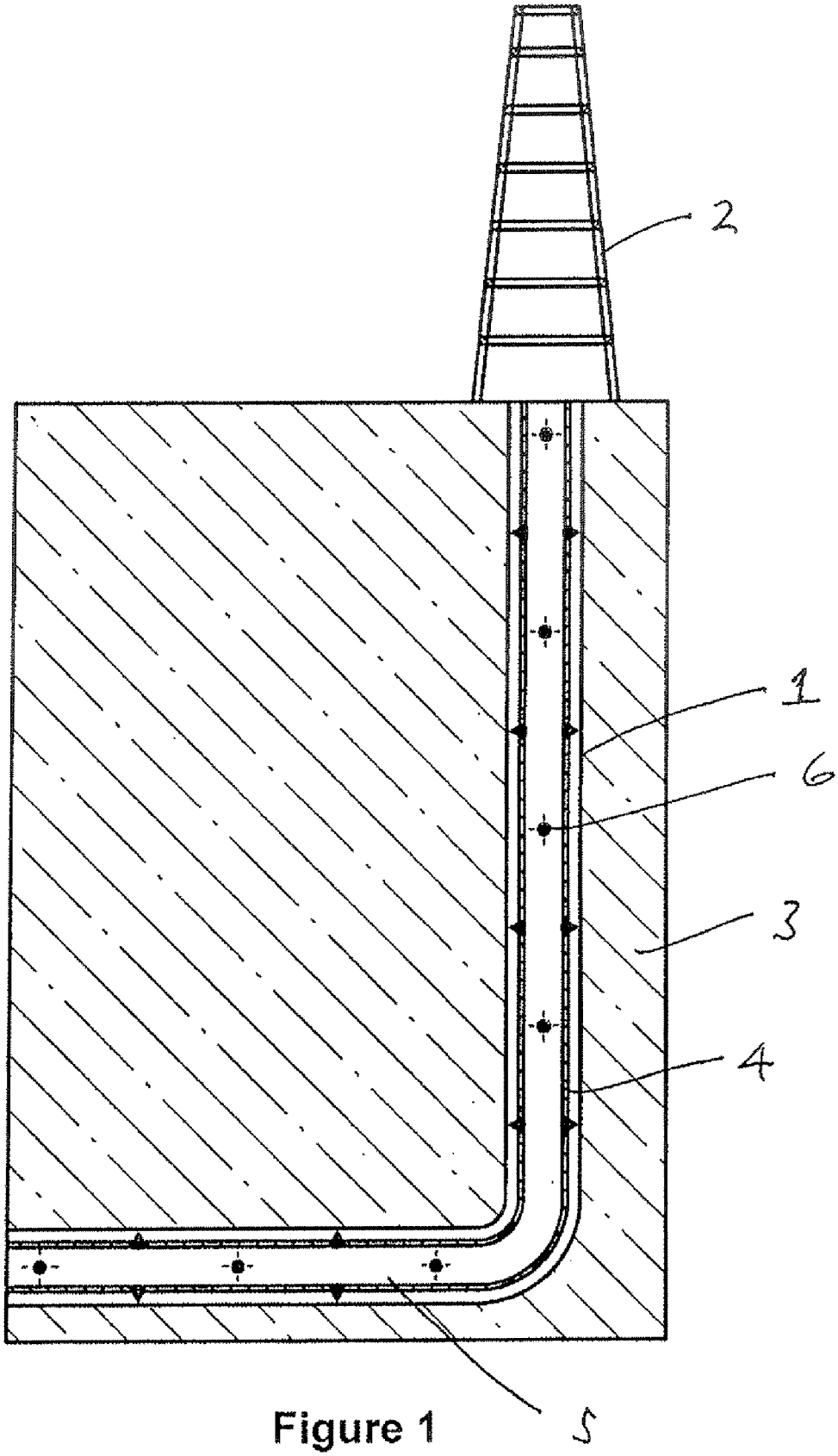
FIG. 1 is a vertical sectional view through a wellbore that has been lined with a perforated liner wherein the perforations are enclosed with plugs in accordance with one of the preferred embodiments of the present invention.
Figure 2:
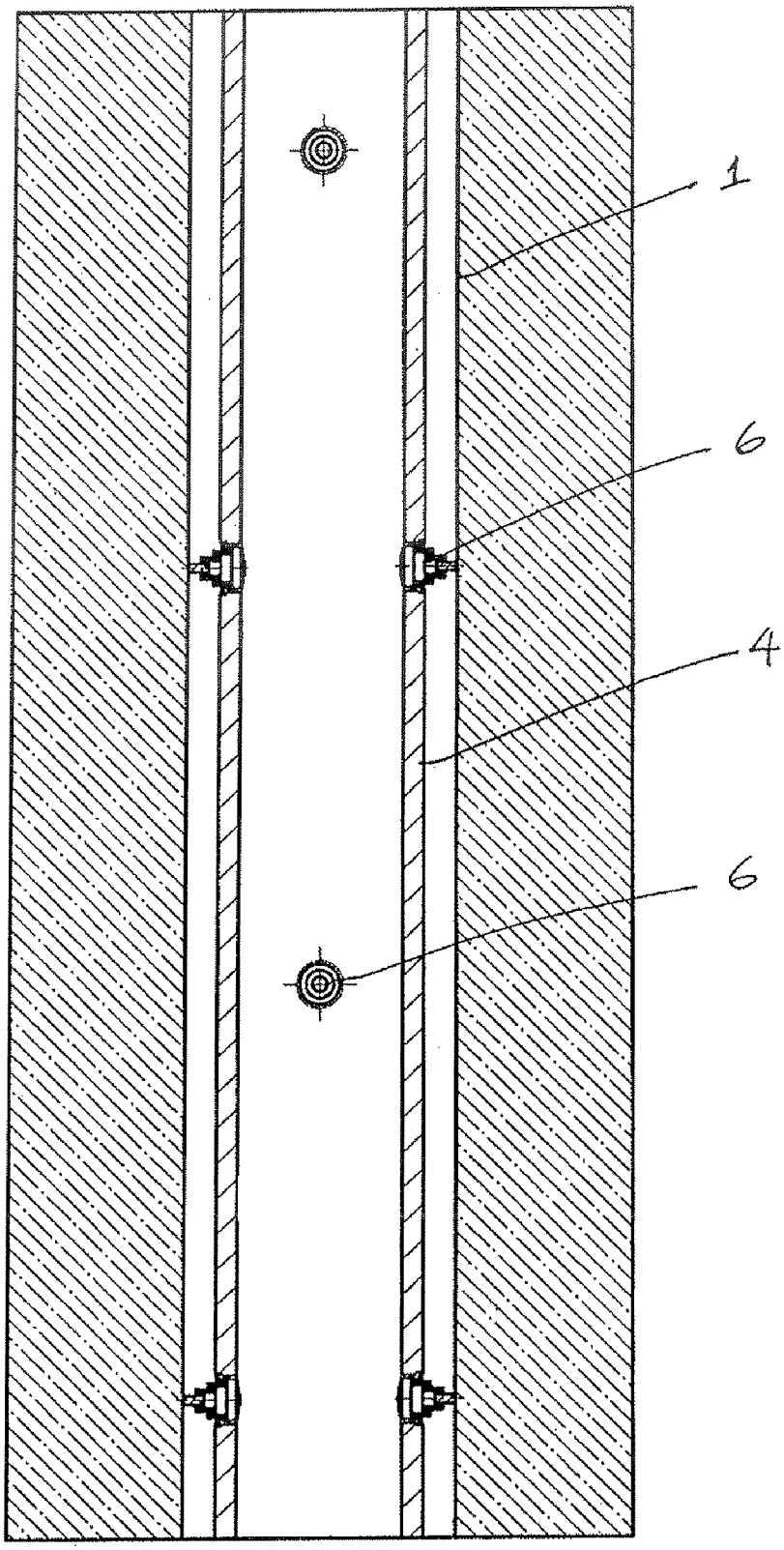
FIG. 2 is an enlarged sectional view of a lined borehole wherein the liner has plugs in accordance with one of the preferred embodiments of the invention inserted within perforations.
Figure 3:
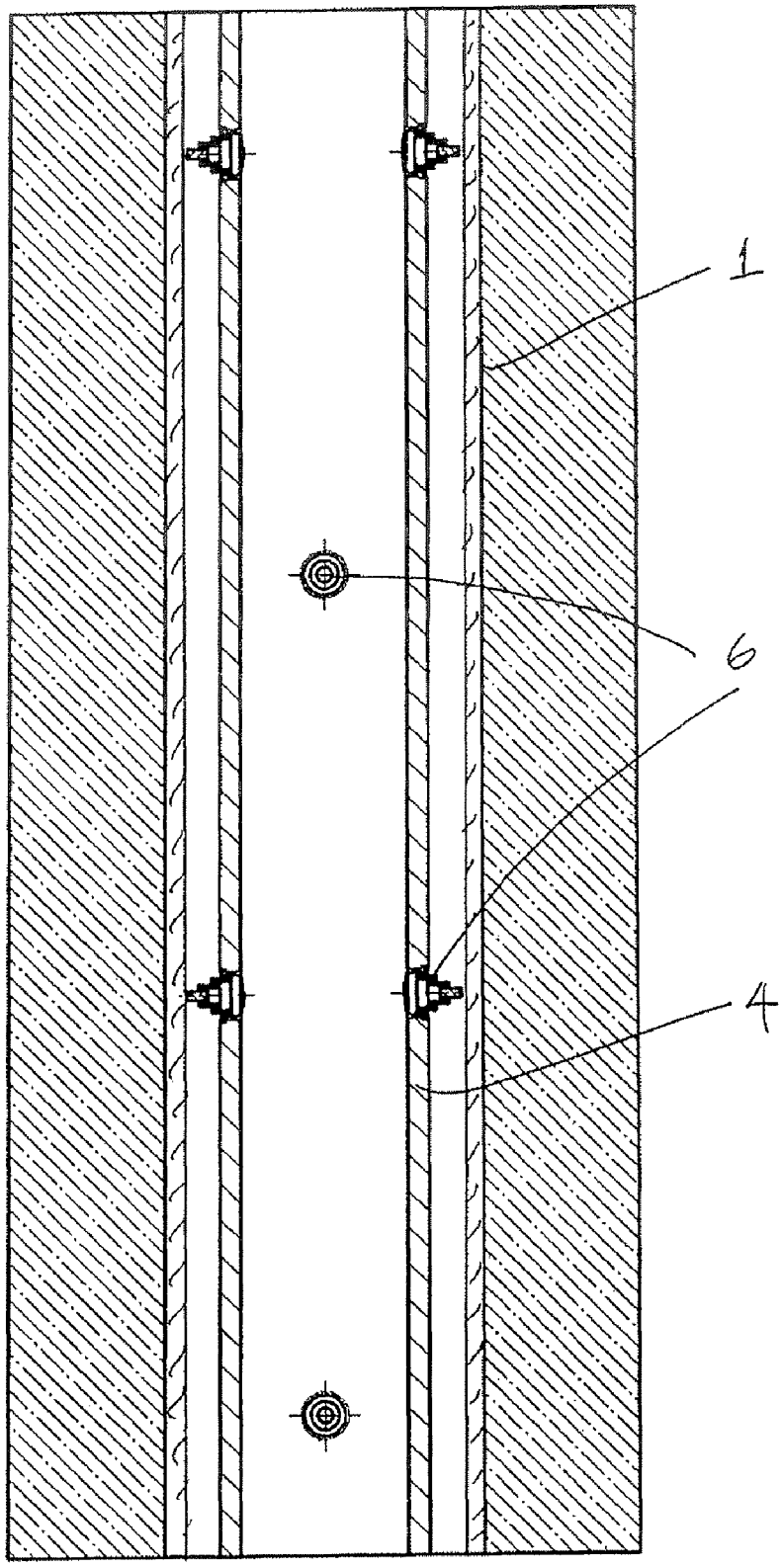
FIG. 3 is a Figure similar to FIG. 2 wherein the borehole is cased.
Figure 4:
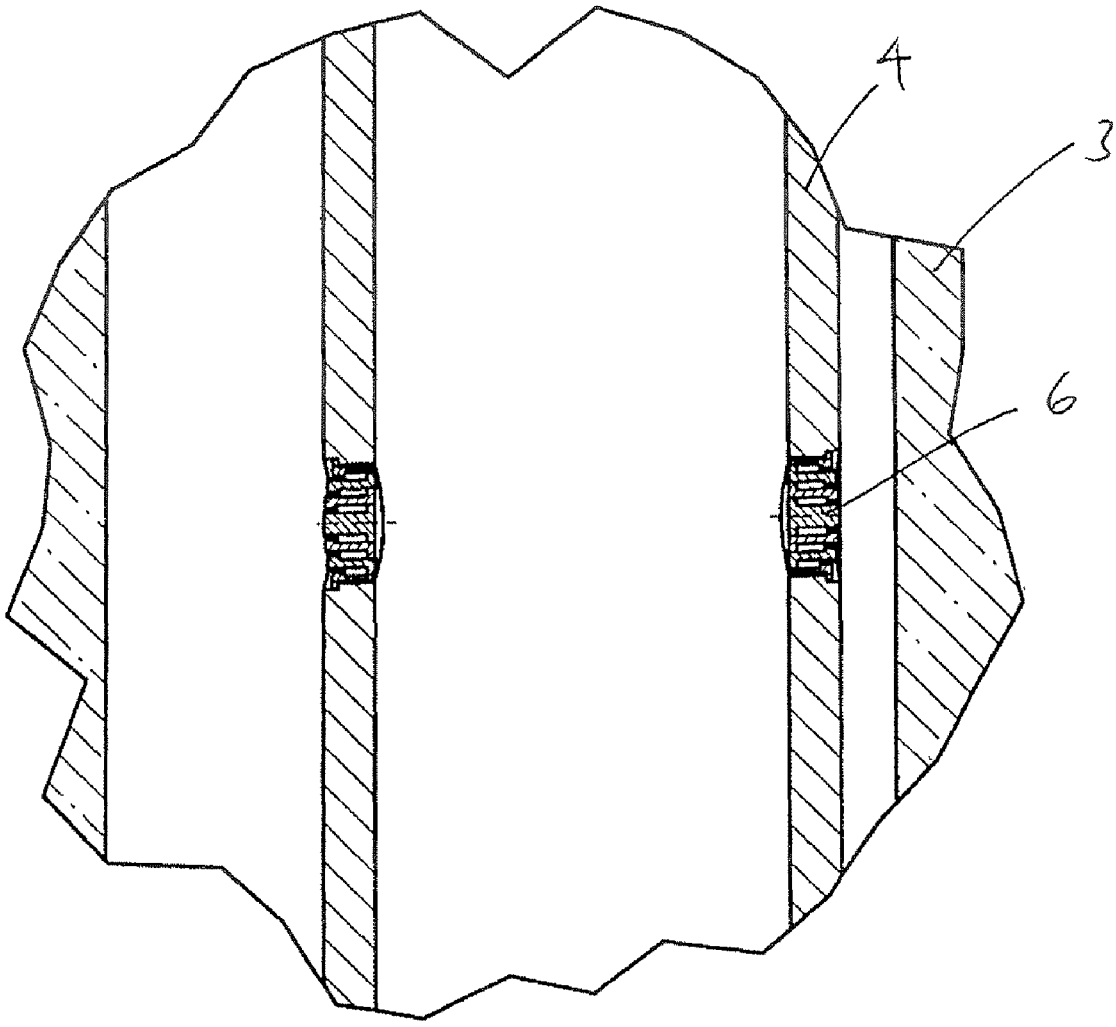
FIG. 4 is an enlarged sectional view of a borehole having a perforated liner with plugs in accordance with one of the preferred embodiments of the invention inserted within the perforations and wherein the plugs are generally flush with the exterior surface of the liner.
Figure 5:
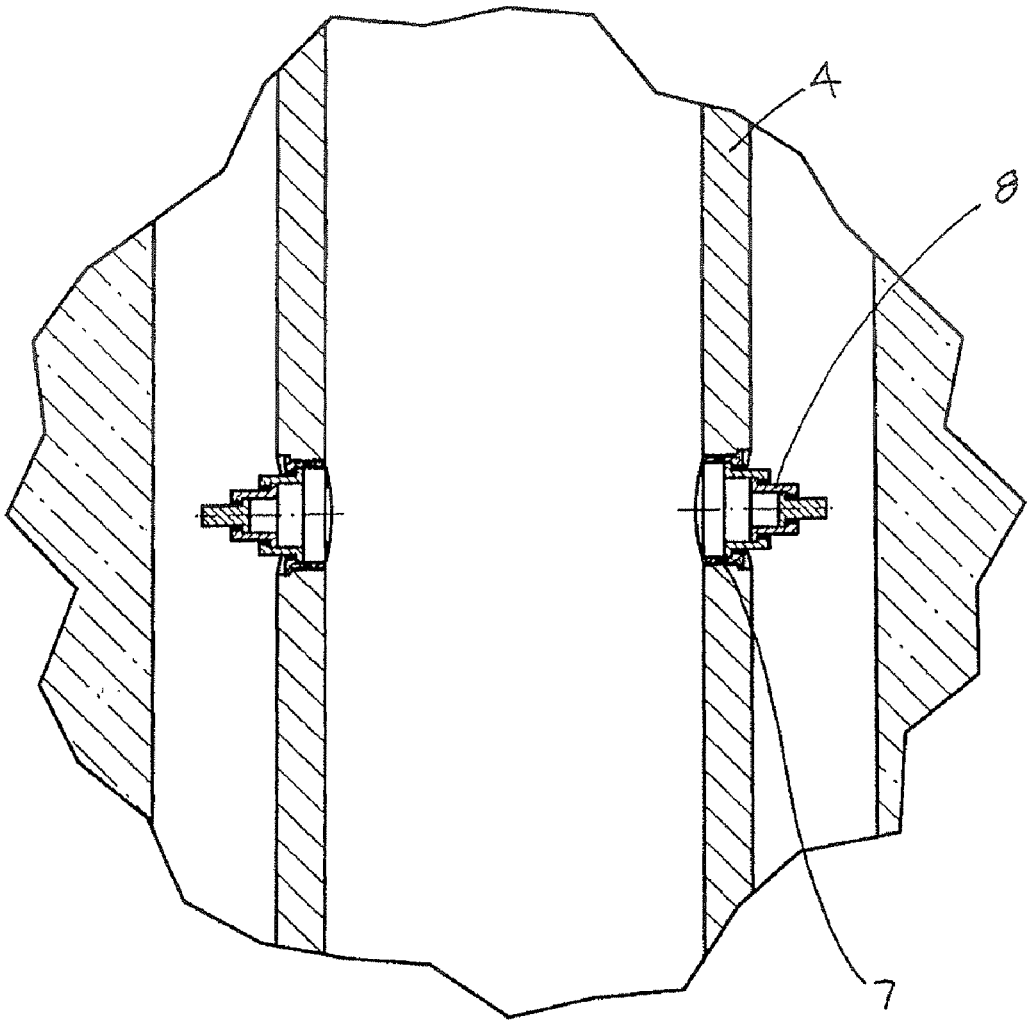
FIG. 5 is a view similar to FIG. 4 wherein the plugs are in an extended position.
Figure 6:
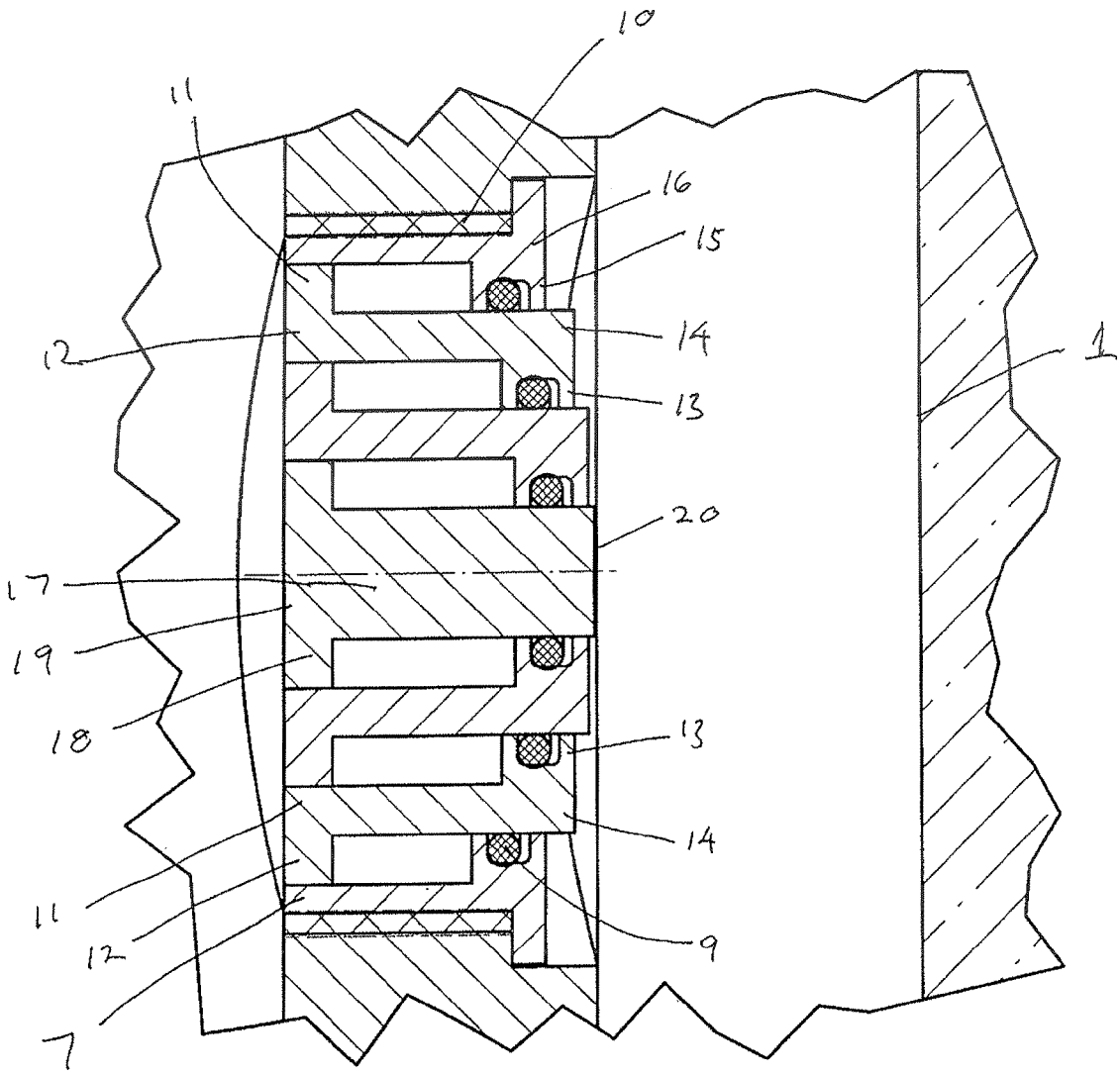
FIG. 6 is an enlarged sectional view of the plugs shown in FIG. 4.
Figure 7:
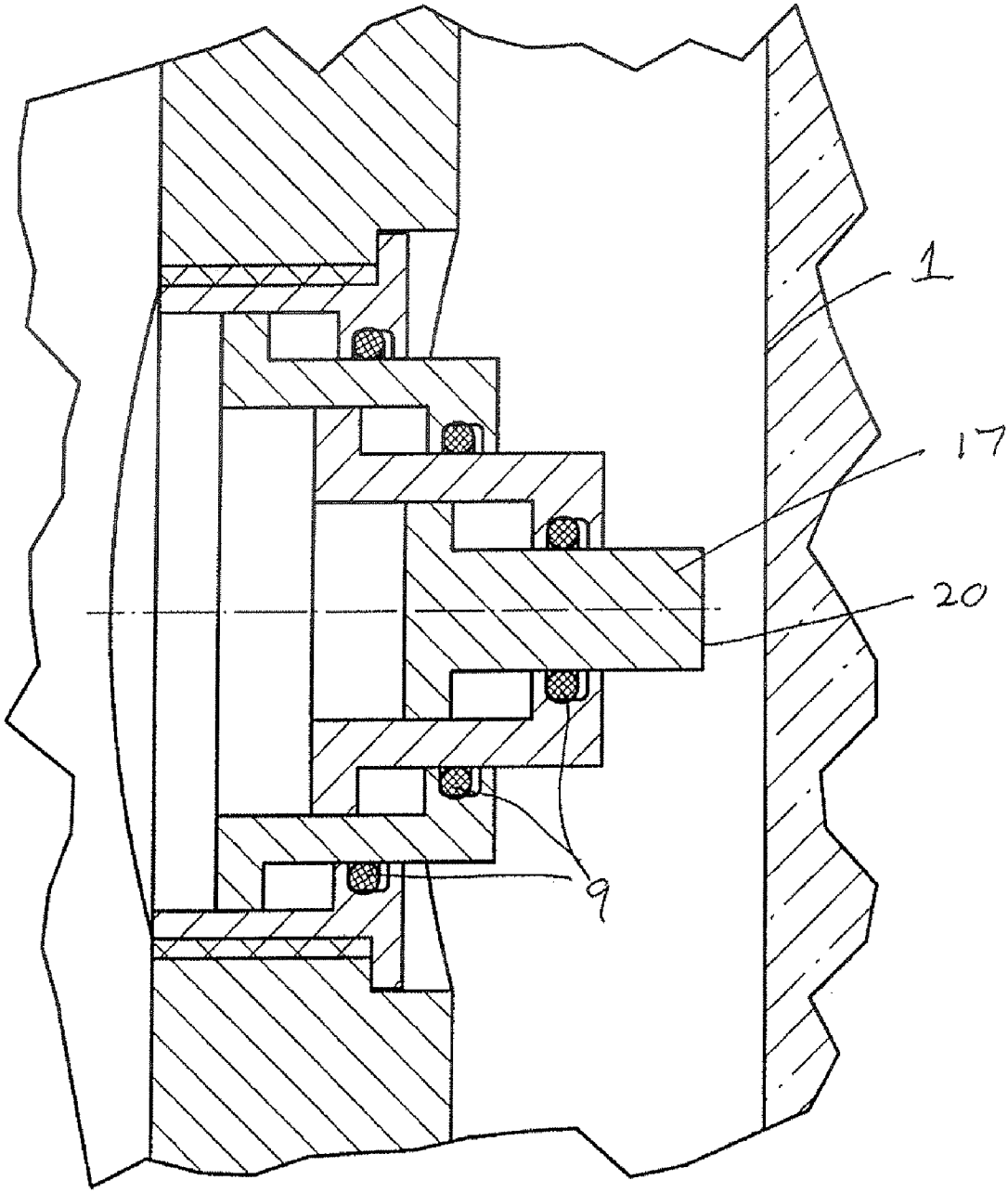
FIG. 7 is a view of the plug shown in FIG. 6 in a partially deployed position.
Figure 8:
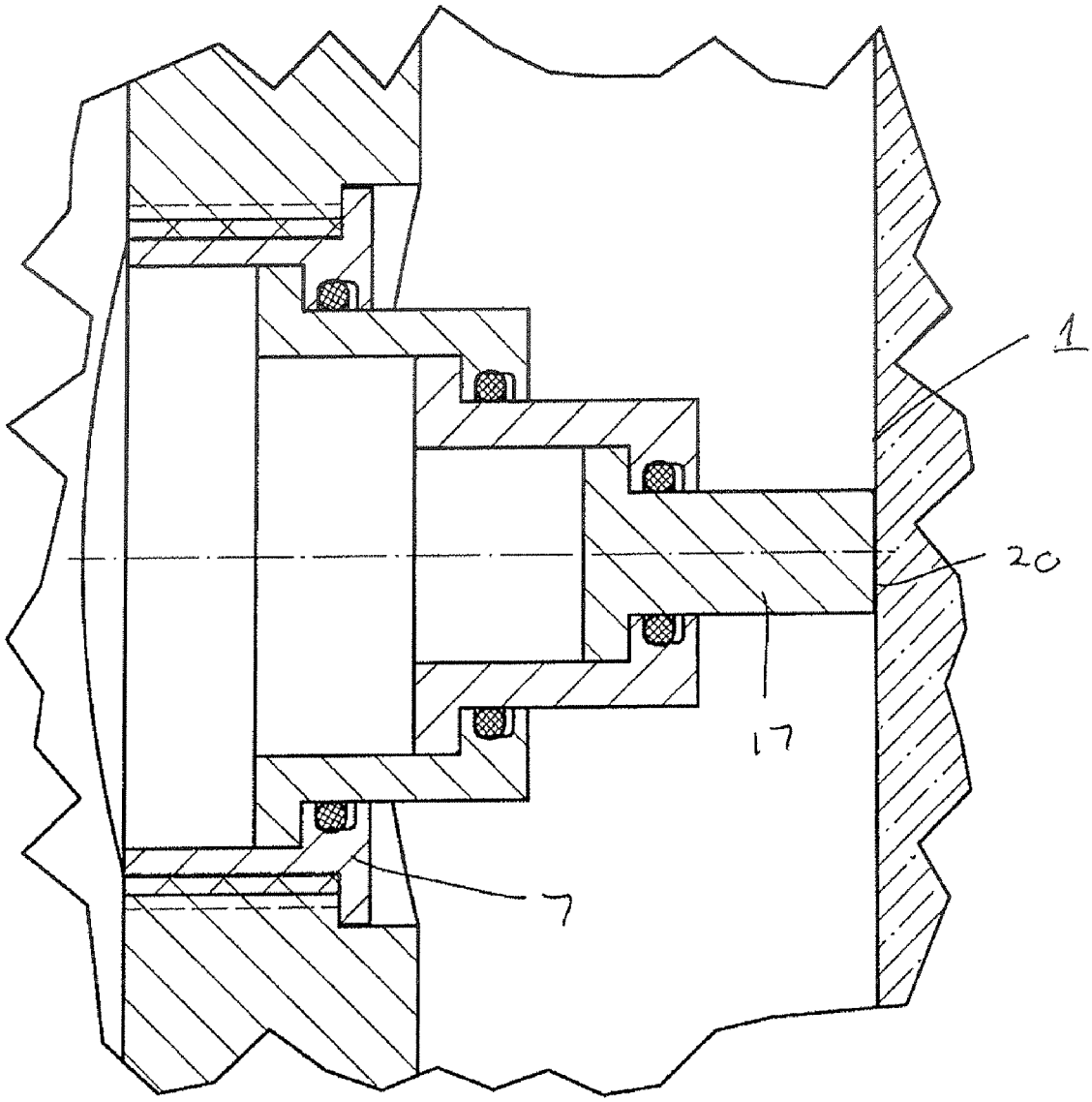
FIG. 8 a view of the plug shown in FIG. 6 in a fully deployed position.
Figure 9:
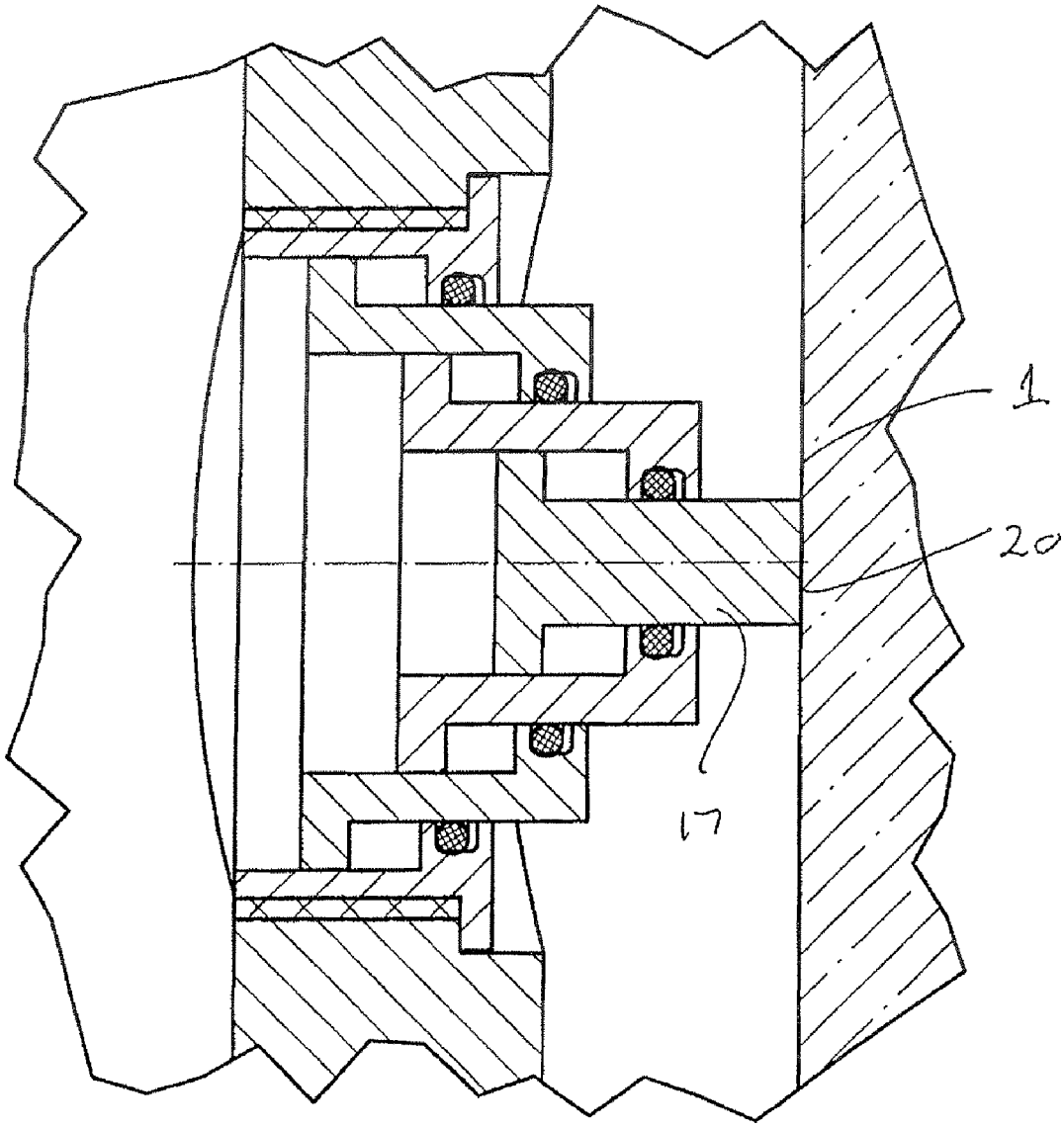
FIG. 9 is a view similar to FIG. 8 wherein the plug is in a deployed position.

With reference to FIG. 1 there is shown a vertical section through a typical borehole 1 extending from a surface rig 2 into an underground formation 3. It will be appreciated by those skilled in the art that the configuration and nature of the borehole can vary substantially from application to application. For example, as shown in FIG. 1 the borehole may have a horizontal section. In addition, the borehole may be cased or uncased, however, the particular configuration and structure of the borehole does not affect the invention. In FIG. 1 the borehole is lined with a liner 4 having perforations. The perforations have plugs 6, constructed in accordance with the present invention, inserted therein.

As shown more specifically in FIGS. 2 through 6, plug 6 is comprised generally of a base portion 7 and one or more extendible portions 8. The base portion is securable to and receivable within the perforations in liner 4. The base portion, together with the one or more extendible portions, seal the perforation. As is also shown, the extendible portions have a retracted position and an extended position such that when they are in their retracted position the outer surface of the plug is generally flush with the exterior surface of the liner. When the extendible portions are in their extended position they extend outwardly from the base portion and outwardly from the exterior surface of the liner.

In the embodiment of the invention shown in the attached drawings, base portion 7 and extendible portions 8 are formed from circular, cylindrical members that are nested and concentric such that the extendible portions are telescopically received within the base portion. It will be appreciated that the precise geometric configuration and shape of both the base portion and the extendible portions could vary while remaining within the broad scope of the invention. For example, rather than comprising circular, cylindrical members, the cross-section of the extendible portions could be rectangular, hexagonal, octagonal or any one of a wide variety of other geometric shapes. In addition, base portion 7 could also take on a variety of different geometric shapes.

Plug 6 further include seals 9 positioned between adjacent cylindrical members such that when the base portion is received within a perforation the base, in combination with the extendible portions and seals 9, serves to seal the perforation In the embodiment of the invention shown in the attached drawings seals 9 are O-rings, however, it will also be appreciated by those skilled in the art that various other seals could equally be utilized. In the embodiment depicted based portion 7 includes threads 10 to permit it to be threaded into the perforation within liner 4.

FIGS. 6 through 9 show one of the preferred structures that may form base portion 7 and extendible portions 8. In this embodiment the extendible portions have an outwardly oriented flange 11 on their inner ends 12 and an inwardly oriented shoulder 13 on their outer ends 14. In this manner the nesting of a plurality of extendible portions permits an outwardly telescopic movement of the nesting portions while preventing their separation (see FIGS. 7, 8 and 9). An inwardly extending shoulder 15 about the outer edge 16 of base portion 7 retains the nested and telescopic extendible portions within the confines of the plug. As mentioned previously, the placement of O-ring seals 9 between adjacent cylindrical members presents a fluid tight seal between the various parts of plug 6. Preferably the central extendible portion 17 is in the form of a cylindrical member having an annular flange 18 on its inner end 19. The outer end 20 of the central extendible portion 17 will be enclosed and generally flat to permit it to engage the interior surface of borehole 1 or the interior surface of the liner if the borehole is lined.

Through construction of plug 6 in accordance with the preferred embodiment shown in the attached drawings and as described above, deployment of the plug such that the extendible portions are moved from their retracted to extend positions can be accomplished by pressurizing the interior of liner 4. The sealing of base portion 7 within the perforation and the use of seals at 9 between adjacent cylindrical members allows the plug to retain pressurized fluid within the liner, forcing the telescopically nested extendible portions to be driven outwardly until either the annular flange 19 on the central extendible portion 17 is driven up against the outer shoulder 13 on the next adjacent extendible portion (see FIG. 8), or until the outer end 20 of the central extendible portion 17 comes into contact with either the borehole wall (see FIG. 9) or the interior surface of the casing if the borehole is cased. Typically, deployment of the extendible portions will be accomplished through packing off a section of the liner and injecting pressurized air or gas into that section. Alternately, the extendible portions may be deployed through pressurizing the liner with a wide variety of other fluids.

In use, a plurality of plugs 6 are inserted into perforations in a section of liner. As mentioned, in one of the preferred embodiments the plugs are threaded into the perforations, however, in alternate embodiments the plugs could also be secured in place through the use of glues or adhesives, through welding, or through press fitting or any other commonly used means. Initially, the extendible portions 8 will be in their retracted position and held roughly in those positions through the interaction of the O-ring seals with adjacent cylindrical portions. The perforated portion of the liner can then be inserted into a well or borehole and positioned at its desired location. Thereafter, the interior of the liner is pressurized causing the extendible portions 8 to move from their retracted to their extended positions, at which point the outer ends 20 of central extendible portions 17 will be in contact with (or in close proximity to) the borehole wall. At that point cementing operations can commence where the annulus between the liner and the wellbore is filled or injected with cement or a cementatous-type material. Once the cement or cementatous-type material has hardened or cured, at least the extendible portions of the plugs are destroyed, leaving the liner cemented in place, while at the same time providing access to the face of the bore hole through the perforations in the liner.

Destruction of the extendible portions can be accomplished through a variety of different mechanisms. In one embodiment the extendible portions are constructed from material that dissolves when exposed to acid and the destruction of the extendible portions involves exposing the plugs to an acidic solution for a sufficient length of time to dissolve at least the extendible portions of the plugs. This process would typically be accomplished through packing off the liner and delivering the acidic solution by running coiled tubing into the well. To that end, the extendible portions (and for that matter the base portion as well if desired) can be formed from an aluminium alloy which can be dissolved through subjecting to an acid. Alternately the extendible portions could be constructed from a variety of plastics or other materials. In alternate embodiments the extendible portions can be constructed from materials that can be destroyed or pulverized and the destruction of the extendible portions could be accomplished through subjecting them to the blast from the detonation of a charge, through drilling, through mechanical impact, or through sonic or ultra-sonic vibration.

Figure 10:
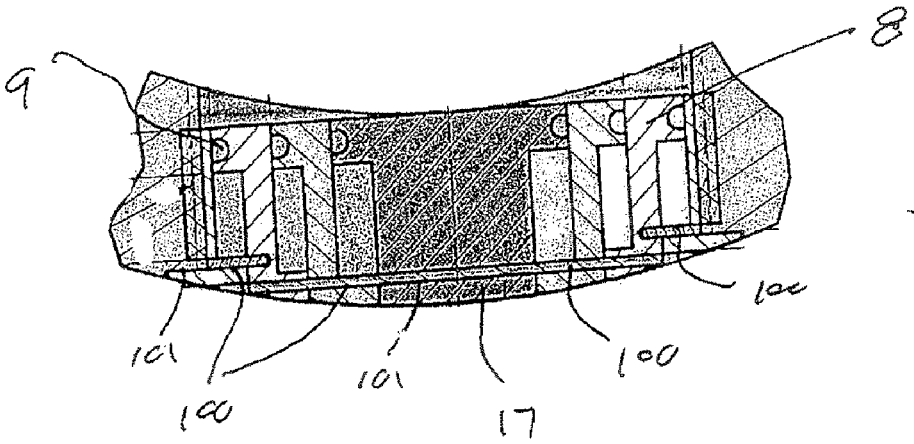
FIG. 10 is an enlarged sectional view of an alternate embodiment of one of the plugs shown in FIG. 4; and, FIG. 11 is an enlarged sectional view of the plug shown in FIG. 10 in its fully deployed position.
Figure 11:
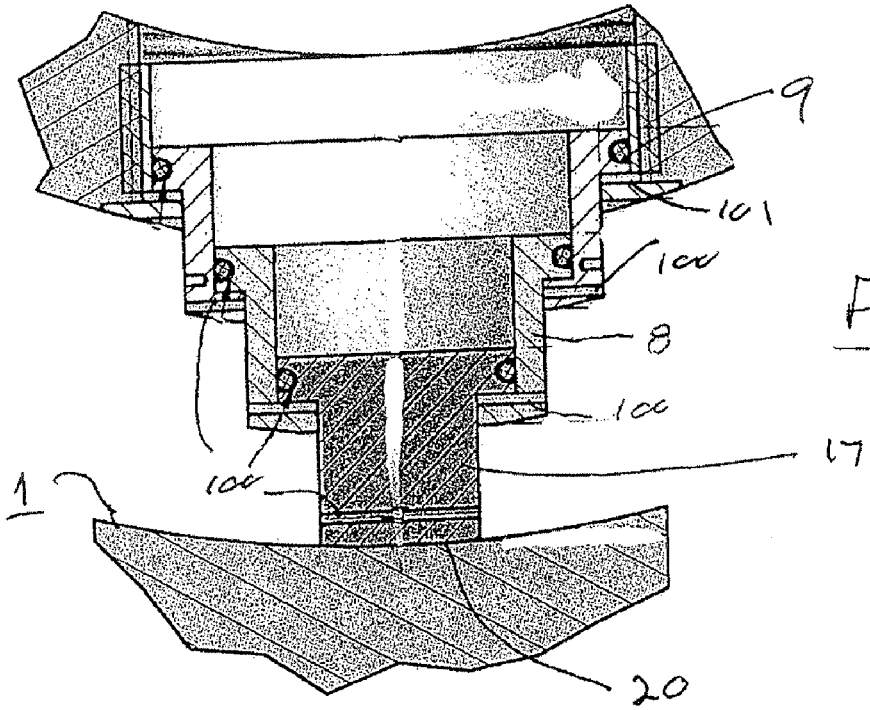

An alternate embodiment of plug 6 is shown in FIGS. 10 and 11. In this embodiment the plug is constructed generally in accordance with the plug shown in FIGS. 1 through 9, however, a series of shear pins 100 extend through base portion 7 and extendible portions 8 when the extendible portions are in their retracted position (as specifically shown in FIG. 10). It will be appreciated from a thorough understanding of the invention that shear pins 100 when received within correspondingly shaped passageways 101 that extend through base portion 7 and extendible portions 8, will assist in maintaining the extendible portions in their retracted position until such time as sufficient force is applied to the plug to permit the shearing of pins 100 and the deployment of the extendible portions. It will equally be appreciated that although in the attached drawings three shear pins are shown, it would be possible to incorporate one, two, three, or more shear pins within the structure. Preferably, the shear pins will be constructed of a material and will have dimensions such that they will have a sufficiently high shear strength to retain the extendible portions in their retracted positions when desired, while at the same time having a sufficiently low shear strength that will enable the pins to be sheared by the pressurizing of the interior of liner 4 through the use of conventional equipment. The pins 100 may also be sheared through being subjected to mechanical force, through a directed blast force, through ultra sonic vibration or through a variety of other methods.

Shear pins 100 may be made from a variety of different materials including aluminum, plastics or other materials the same or similar to those from which the base and extendible portions of the plug are formed. Preferably the pins are dissolved, pulverized or otherwise suitably or substantially destroyed at the same time and through the same means that the various other portions of the plug are destroyed. However, in light of their relatively small size, the failure to destroy or completely destroy the pins should have no appreciable affect on the extraction of production fluid from the well after the plugs have been deployed and their extendible portions destroyed or pulverized. The use of shear pins 100 will help to maintain and stabilize the plugs in their retracted position during transport of the liner, during insertion into the well, and generally until such time as deployment is desired. The shear pins will also help to prevent the plugs from being driven inwardly into the liner if exposed to external pressure or force. The shear pins are particularly useful in maintaining the plugs in their retracted positions in horizontal well applications.

It will be appreciated by those of reasonable skill in the art and having a thorough understanding of the invention as described and shown herein that the use of plugs 6 within the perforations of a liner will allow for the centralization of the liner within the borehole and also effectively present a tunnel leading from the interior of the liner to the face of the formation once the liner has been cemented in place, and at least the extendible portions of the plug are disintegrated, dissolved or otherwise destroyed. The use of such plugs removes the need for subsequently entering the well with perforating guns or other mechanical devices that have previously been used to perforate a liner in situ. In addition, whereas existing plugs can be used to fill perforations and later dissolved, the plugs of the present invention present the ability to maintain a tunnel or effectively a direct conduit that terminates at the face of the borehole, whereas standard plugs, once dissolved, still require the dissolution or destruction of the cement between the plug and the face of the borehole.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A plug for insertion into a perforation in a liner or tubular, the plug comprising a base portion and one or more extendible portions, said base portion securable to and receivable within the perforation, said base portion and said one or more extendible portions sealing the perforation in said liner, said one or more extendible portions having a retracted position and an extended position such that when in said extended position said one or more extendible portions extend outwardly from said base portion and outwardly from the exterior surface of said liner; said plug including one or more shear pins retaining said extendible portions in said retracted position until sufficient force is applied to said extendible portions to shear said shear pins; said extendible portions entirely constructed from one or more materials to provide means for permitting the extendible portions to dissolve when exposed to an acid, or be pulverized or destroyed when subjected to a pre-determined level of sonic energy when subjected to the blast from the detonation of a charge, through drilling or through impact.

2. The plug as claimed in claim 1 wherein the outer surface of said plug is generally flush with the exterior surface of said liner when said one or more extendible portions are in said retracted positions.

3. The plug as claimed in claim 1 including a plurality of said extendible portions, said plurality of extendible portions telescopically received within said base portion.

4. The plug as claimed in claim 3 wherein said base and said extendible portions are in the form of nested, concentric, cylindrical members.

5. The plug as claimed in claim 4 including seals between adjacent cylindrical members.

6. The plug as claimed in claim 1 wherein said extendible portions are movable from said retracted to said extended position through pressurizing the interior of said liner.

7. The plug as claimed in claim 1 wherein said extendible portions are movable from said retracted to said extended position through pressurizing the interior of said liner to a predetermined degree sufficient to shear said shear pins.

8. The plug as claimed in claim 1 wherein said base portion is threadably received within said perforation.

9. Use of the plug claimed in claim 1 to assist in centering said liner within a bore hole.

10. A plug for insertion into a perforation in a liner or tubular, the plug comprising a base portion securable to and received within a perforation in the liner, the plug further comprising one or more extendible portions having a retracted position and an extended position, when in said extended position said one or more extendible portions extending outwardly from said base portion and outwardly from the exterior surface of the liner, said base portion and said one or more extendible portions together sealing the perforation in said liner, the plug including one or more shear pins retaining said one or more extendible portions in said retracted position until such time as said shear pins are exposed to a shearing load in excess of their shear strength; said extendible portions entirely constructed from one or more materials to provide means for permitting the extendible portions to dissolve when exposed to an acid, or be pulverized or destroyed when subjected to a pre-determined level of sonic energy when subjected to the blast from the detonation of a charge, through drilling, or through mechanical impact.

11. The plug as claimed in claim 10 wherein said extendible portions are movable from said retracted to said extended position through pressurizing the interior of the liner.

12. The plug as claimed in claim 10 including a plurality of said extendible portions, said base portion and said extendible portions comprising nested, concentric, cylindrical members, said plurality of extendible portions are telescopically received within said base portion.

13. A method of using and deploying a plug for insertion into a perforation in a liner or tubular to be inserted into a bore hole, the plug comprising a base portion and one or more extendible portions, said base portion securable to and receivable within the perforation, said one or more extendible portions having a retracted position and an extended position, said one or more extendible portions extending outwardly from said base portion and outwardly from the exterior surface of said liner when in said extended positions, said plug including one or more shear pins retaining said one or more extendible portions in said retracted position until such time as said shear pins are exposed to a shearing load in excess of their shear strength, said extendible portions entirely constructed from one or more materials to provide means for permitting the extendible portions to dissolve when exposed to an acid, or be pulverized or destroyed when subjected to a pre-determined level of sonic energy when subjected to the blast from the detonation of a charge, through drilling, or through mechanical impact, the method comprising:

(i) inserting said plug into a perforation in the liner or tubular and securing said plug thereto;

(ii) positioning the liner or tubular at a desired location within a wellbore;

(iii) pressurizing the interior of the liner or tubular to a sufficient degree to shear said shear pins and to move said one or more extendible portions from said retracted to said extended positions such that they extend outwardly from the exterior surface of said liner;

(iv) cementing said liner or tubular in place within said wellbore through pumping or otherwise injecting cement or a cementatous-type material into the annulus between said liner and said wellbore; and, (v) subsequently destroying at least one or more extendible portions of said plug through subjecting said extendible portions to an acidic solution, through subjecting said extendible portions to the blast from the detonation of a charge, through drilling, through mechanical impact or through sonic or ultrasonic vibration.

* * * * *